US006963308B2

(12) United States Patent
Korva

(10) Patent No.: US 6,963,308 B2
(45) Date of Patent: Nov. 8, 2005

(54) MULTIBAND ANTENNA

(75) Inventor: Heikki Korva, Kempele (FI)

(73) Assignee: Filtronic LK Oy, Kempele (FI)

( * ) Notice: Subject to any disclaimer, the term of this patent is extended or adjusted under 35 U.S.C. 154(b) by 24 days.

(21) Appl. No.: 10/754,040

(22) Filed: Jan. 7, 2004

(65) Prior Publication Data

US 2004/0140935 A1 Jul. 22, 2004

(30) Foreign Application Priority Data

Jan. 15, 2003 (FI) ..... 20030059
Apr. 15, 2003 (FI) ..... 20030567

(51) Int. Cl.[7] ..... H01Q 1/38
(52) U.S. Cl. ..... 343/700 MS
(58) Field of Search ..... 343/702, 700 MS, 343/770, 767, 845

(56) References Cited

U.S. PATENT DOCUMENTS 5,786,793 A * 7/1998 Maeda et al. ..... 343/700 MS
5,926,139 A 7/1999 Korisch
5,936,583 A 8/1999 Tadahiko et al.
6,466,170 B2 * 10/2002 Zhou ..... 343/700 MS
6,529,168 B2 * 3/2003 Mikkola et al. ..... 343/702
6,573,869 B2 * 6/2003 Moore ..... 343/702
6,664,931 B1 * 12/2003 Nguyen et al. ..... 343/767

FOREIGN PATENT DOCUMENTS

EP 0 707 355 A1 4/1996
EP 0 923 158 A2 6/1999
EP 1 067 627 A1 1/2001
EP 1 094 545 A2 4/2001
EP 1 146 590 A2 10/2001
EP 1 248 316 10/2002
WO WO-02/50948 A1 6/2002

OTHER PUBLICATIONS

Patent Abstracts of Japan, vol. 1999, No. 10, Aug. 31, 1999, Application JP 11 127010 (Sony Corp.).

* cited by examiner

*Primary Examiner*—Don Wong
*Assistant Examiner*—Huedung X. Cao
(74) *Attorney, Agent, or Firm*—Darby & Darby

(57) ABSTRACT

An internal multiband antenna and a radio device intended particularly for small-sized radio devices. The antenna has a relatively wide surface radiator (330), which is electromagnetically connected to the antenna port of the radio device via a separate feed element (320). At least two useful resonances are generated with the aid of the feed element, and at least one inherent resonance of the radiator is also utilized. The radiator has a hole (350), by which one useful additional resonance is generated. An oscillation is excited in the hole by placing the feed element close to its edge and by suitably choosing the locations of the feed point (F) and the shorting point (S) of the feed element. The frequency of the hole resonance is finely tuned by varying the capacitance between the hole's edge and the ground plane at a suitable place (331). An operating band of the antenna can be widened by means of said additional resonance. If a mobile station has a rear display it is possible at the same time to use its hole as a radiator.

14 Claims, 3 Drawing Sheets

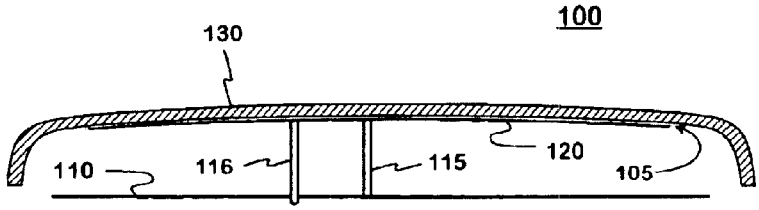
Fig. 1a PRIOR ART
Fig. 1b
PRIOR ART
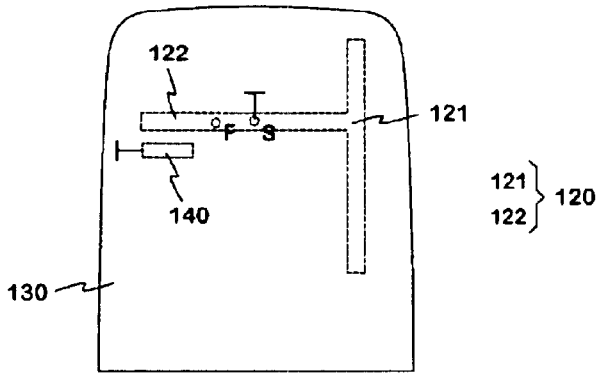
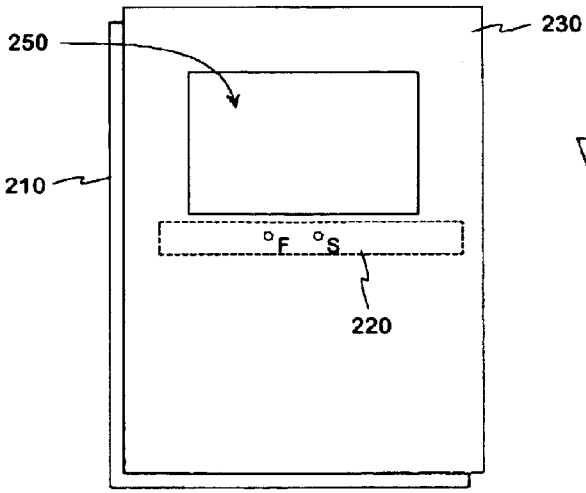
Fig. 2a
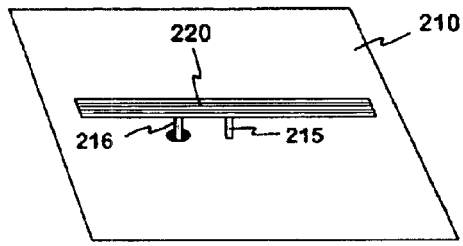
Fig. 2b

MULTIBAND ANTENNA

The invention relates to an internal multiband antenna intended particularly for small-sized radio devices. The invention relates also to a radio device including an antenna according to the invention.

BACKGROUND OF THE INVENTION

In portable radio devices, particularly in mobile stations we prefer to avoid the use of an antenna for convenience, which projects outside the cover of the device. In most cases internal antennas of mobile stations have a planar structure: The antenna comprises a radiating plane and a ground plane in parallel with it. In order to facilitate the impedance matching the radiating plane and the ground plane are usually interconnected at a suitable point by a shorting conductor, whereupon a planar inverted F-antenna (PIFA) is produced. The electrical characteristics of the planar antenna, such as the bandwidth and the antenna gain, depend on the distance between said planes, among other things. As the mobile stations become smaller also in the direction of the thickness, said distance is reduced unavoidably, whereby the electrical characteristics become poorer. This problem relates particularly to foldable mobile phones, as their fold parts are relatively flat. In practice such foldable models have projecting antennas.

The space utilisation of a radio device can be improved i.a. by arranging the radiating element of the antenna as a part of the device cover, which is known as such. The applicant knows the arrangement described in his own application FI20030059, where the radiating cover element has electromagnetic feed in order to obtain further advantages. FIGS. 1*a* and 1*b* show a solution of this kind. FIG. 1*a* shows a magnified cross-section of the antenna 100. There is a part 130 of the cover of the radio device, which functions as the radiator and below it the ground plane 110 of the antenna. A thin dielectric layer 105 lies against the slightly curved internal surface of the radiator 130 and a strip-like feed element 120 of the antenna lies on the surface of the dielectric layer. The layer 105 and the feed element 120 can together form for instance a flexible circuit board. Between the radiator and the feed element there is only an electromagnetic coupling, which is considerably strong due to the thinness of the dielectric layer. The antenna's feed conductor 116 and the shorting conductor 115 are galvanically connected to the feed element 120. The feed conductor extends through the ground plane to the antenna port of the radio device, insulated from the ground plane. The shorting conductor connects the feed element directly to the ground plane at the short circuit point S.

FIG. 1*b* shows the antenna 100 from outside of the device. There the radiator 130 is for instance one half of the mobile phone's back cover. The feed element 120 is represented by a broken line. In this example it is a conductor strip in a form resembling a T-letter, the stem of which extends in the width direction of the radio device, across the radiator, and the perpendicular "crossbeam" extends in the length direction of the radio device, close to one side edge of the radiator. The antenna's feed point F and the short-circuit point S mentioned above are located about in the middle of the stem. The short circuit point divides the feed element into two parts so that the antenna has two operating bands. The first part 121 of the feed element together with the radiator and the ground plane resonates in the range of the antenna's lower operating band, and the other part 122 of the feed element together with the radiator and the ground plane resonates in the range of the antenna's upper operating band. Thus the lengths of the first and second parts do not as such correspond to the wavelengths at the operating bands, but the coupling to the relatively large radiating element increases the electrical lengths of the parts of the feed element, so that these correspond to the intended wavelengths. It is also possible to excite such resonances in the antenna structure 100 which mainly depend only on the size of the radiator and on its distance from the ground plane. A resonance of this kind can be arranged for instance in the range of the upper operating band in order to widen it. For this purpose FIG. 1*b* shows a tuning element 140 drawn by broken line, which element is a conductor strip close to the feed element 120, and it is separated from the radiator 130 in the same manner as the feed element. The tuning element 140 is galvanically connected to the ground plane. FIG. 1*b* shows this connection, as well as the ground connection of the short-circuit point S, by a graphic symbol.

The antenna structure described above provides considerably broad bandwidths even in a flat radio device beside the fact that the radiator does no occupy space within the device also because the distance between the ground plane and the feed element, due to the relatively wide radiator, can be made slightly shorter than the distance between the ground plane and the radiating plane in a corresponding PIFA. However, improvements in the electric characteristics of the antenna are always desirable in order to secure the quality of radio connections.

SUMMARY OF THE INVENTION

The object of the invention is to implement a multiband antenna in a small-sized radio device in a new and more advantageous way. The antenna according to the invention is characterised in what is presented in the independent claim 1. A radio device according to the invention is characterised in what is presented in the independent claim 12. Some preferred embodiments of the invention are presented in the other claims.

The basic idea of the invention is as follows: The antenna has a relatively wide surface radiator, which is connected to the antenna port of the radio device via a separate feed element electromagnetically. At least two useful resonances are generated with the aid of the feed element, and at least one resonance of the radiator itself is also utilised. The radiator has a hole, by which one useful additional resonance is generated. An oscillation is excited in the hole by locating the feed element close to its edge and by choosing suitable locations for the feed and shorting points on the feed element. The frequency of the hole resonance is fine-tuned by varying the capacitance between the edge of the hole and the ground plane at a suitable place.

An advantage of the invention is that a certain operating band of the antenna can be widened with the aid of said additional resonance. An increase of the bandwidth is due to that the frequency of the additional resonance is located at a point within said operating band, which point differs from the frequency of a certain other resonance used to form this operating band. Thanks to the improved band characteristics the antenna can also be made lower than a corresponding prior art antenna. A further advantage of the invention is that when it is applied in a mobile station provided with a back display the hole does not require a separate manufacturing stage, as the radiator in any case has a hole for the display.

BRIEF DESCRIPTION OF THE DRAWINGS

The invention is described in detail below. In the description reference is made to the enclosed drawings, in which FIGS. 1*a, b* show an example of a prior art multiband antenna;

FIGS. 2*a, b* show an example of the structure in principle of a hole radiator according to the invention, FIGS. 3*a, b* show an example of a multiband antenna according to the invention.

DETAILED DESCRIPTION OF THE INVENTION

Figure 3A:
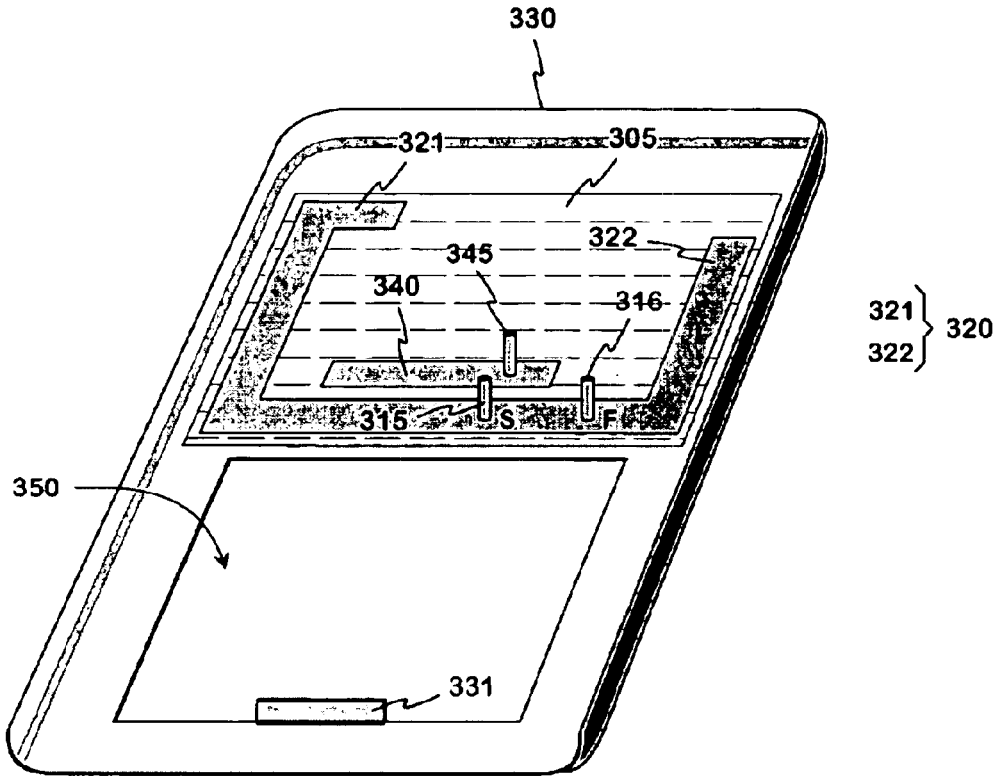

In FIGS. 2*a* and 2*b* there is an example of the principle of the hole radiator used in an antenna according to the invention. FIG. 2*a* shows the structure in a top view, i.e. from the outside of the outer surface of the radiating element, and FIG. 2*b* shows the structure without the radiating element. The radiating element 230 is planar, and it has a relatively wide rectangular hole 250. A "hole" means a region in a conductor plane without conducting material, not being extended to any edge of the conductor plane. Below the radiating element 230 there is a ground plane 210 of the same size as the radiating element and in parallel with it. A feed element 220 is located between the ground plane and the radiating element, shown by a broken line in FIG. 2*a*. The feed element is separated galvanically from the radiating element and galvanically connected to the ground plane from the short circuit point S of the feed element via the shorting conductor 215. During use the feed element is further connected to the antenna port of the radio device, from the feed point F by the feed conductor 216.

In this example the feed element 220 is a straight conductor strip, and it tracks along one edge of the hole 250. Seen in the direction of the normal of the radiating element the feed element is at the conductor surface, slightly outside the hole. The short circuit point S is located about at the middle of the edge of the hole, and the feed point F is relatively close to the short circuit point. The electromagnetic coupling between the feed element and the radiating element is considerably strong due to the short distance between them. Feeding the antenna with a certain frequency causes then such a current distribution in the radiating element around the hole that an oscillation is excited in the hole, and it radiates electromagnetic energy. Said frequency, or the resonance frequency of the hole, depends of course on the dimensions of the hole. Further it depends on the distance to the ground plane and on the detailed shape of the conductors round the hole.

Thus the hole 250 is the actual radiator described above. However, as there can be no hole without a conductor plane, this plane is called a radiating element.

Figure 3B:
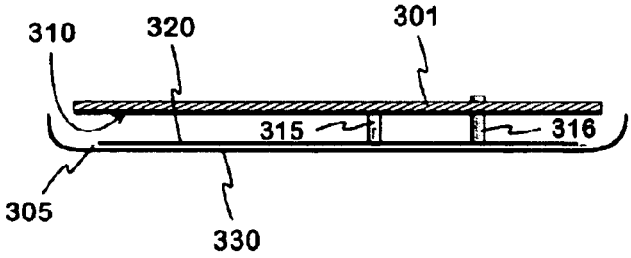

FIGS. 3*a* and 3*b* show an example of an antenna according to the invention, which has at least two operating bands. FIG. 3*a* shows the antenna from the inside, the ground plane removed, and FIG. 3*b* shows it in a cross section. The antenna is a combination of the known antenna in FIG. 1 and the structure according to FIG. 2. The radiating element 330 is a planar, almost rectangular piece having curved edges, so that it is suitable as a part of the cover in a radio device. The radiating element has a hole 350, which occupies the larger part of the area in one half of it. On the inner surface of the other, unbroken half, there is a thin dielectric layer 305, which insulates the strip-like feed element 320 from the radiating element. The feed element has, in the width direction of the radiating element 330, a central part, which extends along one edge of the hole 350, over the whole length of the edge. The feed element continues from both ends of the central part in the length direction of the radiating element. In the central part, at the short circuit point S, the antenna shorting conductor 315 is joined to the feed element, the shorting conductor connecting the feed element to the ground plane 310. The ground plane is presented in FIG. 3 where it is a cross-section of the antenna at the central part of the feed element. In this example the ground plane is a conductive surface of the circuit board 301. Further, the antenna feed conductor 316 is joined to the central part of the feed element in the feed point F. The short circuit point S divides the feed element 320 into a first branch 321 and a second, shorter branch 322. In a similar way as in the antenna of FIG. 1 also here the first branch of the feed element together with the radiating element 330 and the ground plane resonates in the range of the lower operating band of the antenna, and the second branch of the feed element together with the radiating element and the ground plane will resonate in the range of the upper operating band.

In addition to the feed element there is a strip-like tuning element 340 on the surface of the dielectric layer 305. The tuning element has at one point a galvanic connection to the ground plane via the ground conductor 345. The object of the tuning element is to shift a resonance frequency of the resonator formed by the pair of the radiating element 330 and the ground plane 310 to a desired point. The desired point can be located for instance in the range of the upper operating band to make this band wider.

The most substantial essential in the invention is the use of the hole 350. When the hole is suitably dimensioned, an oscillation at a desired frequency is excited in it in accordance with the description of FIG. 2. This adds a useful resonance to improve the characteristics of the antenna. By the hole resonance a separate operating band can be formed, or in the case of a double-band antenna the hole resonance can be used to widen for instance the upper operating band. In order to set the resonance frequency the radiating element 330 has at the edge of the hole 350 an extension 331 directed towards the ground plane. This increases the capacitance between the radiating element and the ground plane and slightly reduces the resonance frequency of the hole. Of course it is possible to locate a tuning element like the extension 331 also at the side of the ground plane.

In FIG. 3*a* the dielectric layer 305, the feed element 320 and the tuning element 340 can together form for instance a flexible circuit board. The conductors 315, 316 and 345 can be attached to the circuit board 301, and in an assembled device they form a reliable contact to the feed or tuning element, for instance through the force of an internal spring.

Figure 4:
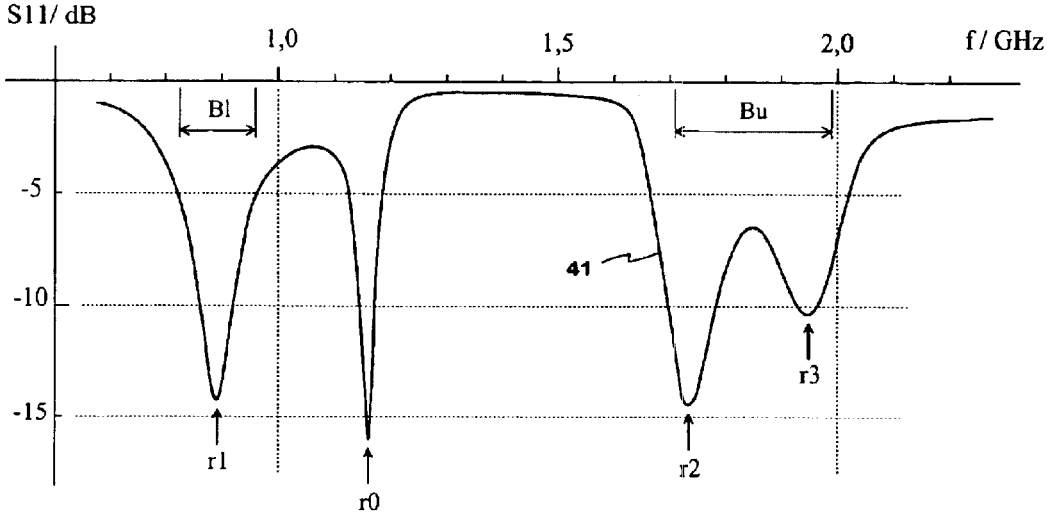
FIG. 4 shows an example of the frequency characteristics of an antenna according to the invention.

FIG. 4 shows an example of the frequency characteristics of an antenna according to the invention. The figure shows the curve 41 of the reflection coefficient S11 as a function of the frequency. The measured antenna is designed to operate in the systems GSM850 (Global System for Mobile telecommunications), GSM 900, GSM1800 and GSM1900. The band required by the former two is located in the frequency range 824–960 MHz, which is the lower operating band B1 of the antenna. The band required by the two latter is located in the frequency range 1710–1990 MHz, which is the upper operating band Bu of the antenna. The diagram shows that in the lower operating band the reflection coefficient of the antenna is less than −5 dB. In the upper operating band the reflection coefficient of the antenna is less than −7 dB. The curve 41 has three distinct resonance points within the operating bands. In the lower operating band there is the first resonance point is r1, which is due to the structure formed by the first part of the feed element together with the radiating element and the ground plane. On the upper operating band there are the second r2 and third r3 resonance points. The second resonance point is located at the lower boundary of the upper operating band Bu, and it is due to the structure formed by the second part of the feed element together with the radiating element and the ground plane. The third resonance point r3 is close to the upper boundary of the upper operating band. Two different resonances affect at this point. One is the hole resonance and the other is the resonance of the resonator formed by the pair of the radiating element and the ground plane. The upper band of the antenna covers in all the range 1670–2030 MHz, using as criterion the value −5 dB for the reflection coefficient. The relative bandwidth is then 20%. This large bandwidth is obtained although the height of the measured antenna is only 4 mm.

In FIG. 4 is to be seen further a fourth resonance point r0 at the frequency 1.16 GHz, in other words outside the operating bands. This is the basic resonance frequency of the resonator formed by the radiating element and the ground plane together. The resonance frequency of this structure mentioned above, which is located in the upper operating band, is a harmonic of the basic resonance frequency.

Figure 5:
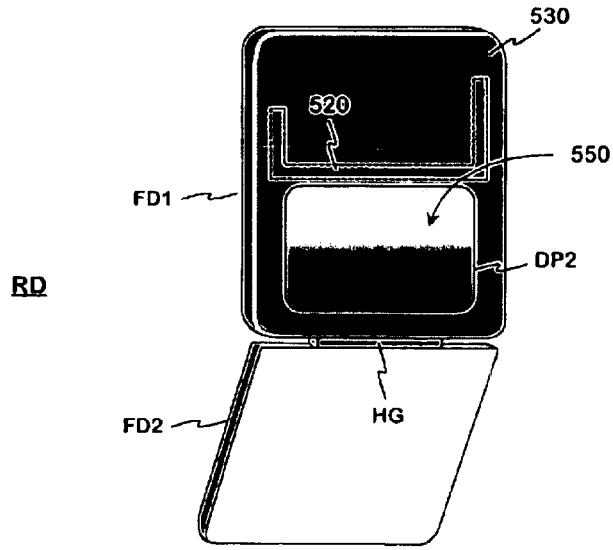
FIG. 5 shows an example of a radio device according to the invention.

FIG. 5 shows an example of a radio device according to the invention. The radio device RD is a foldable mobile station. It has a first fold part FD1 and a second fold part FD2, both seen from behind. These parts can be turned in relation to each other around the hinge HG. The main display of the mobile station is located on the front side of the first fold part, on the side not visible in the figure, and the keyboard of the mobile station is located on the front side of the second fold part. The back side 530 of the cover of the first foldable part is made of conductive material and it functions as the radiating element. A second display DP2 of the mobile station is located on the back side of the first fold part. This requires a hole 550 in the radiating element 530. The hole 550 is utilised according to the invention by feeding it through the same feed element as the conductor radiator of the cover, the feed element being insulated from the cover.

In this description and in the claims the epithets "close to" or "close by" mean a distance, which is at least one order shorter than the wavelength of the oscillation occurring in the parts to be described.

Above we described a multiband antenna according to the invention. The shape of the elements in the antenna can differ from what is presented here, and the invention does not place restrictions on the way of manufacture of the elements and the whole antenna. For instance, the radiating element can be a conductor layer on outer surface of a dielectric cover or inside it, and the feed element of the antenna can then be a conductor strip attached directly on the inner surface of the cover. The inventive idea can be applied in different ways, within the limits placed by the independent claims 1 and 13.

What is claimed is:

1. A multiband antenna for a radio device, the antenna having at least a first and a second operating band and comprising a ground plane, a radiating element, a feed element, a feed conductor and a shorting conductor, wherein the radiating element is galvanically insulated from the other conductive parts of the radio device, and the feed conductor and the shorting conductor are connected to the feed element, a connection point of the shorting conductor divides the feed element into a first part and a second part, the first part of the feed element together with the radiating element and the ground plane are arranged to resonate in a range of the antenna's first operating band, and the second part of the feed element together with the radiating element and the ground plane are arranged to resonate in a range of the antenna's second operating band, and the radiating element has a hole, which is arranged to resonate at a third frequency.

2. A multiband antenna according to claim 1, in order to arrange a resonance of said hole, at least that portion of the feed element, to which the feed conductor and shorting conductor are connected, is located close to an edge of the hole.

3. A multiband antenna according to claim 1, comprising a first tuning element, which changes the capacitance between the radiating element and the ground plane, to set frequency of an oscillation to be excited in said hole, or said third frequency.

4. A multiband antenna according to claim 3, the first tuning element being an extension of the radiating element, which extension is directed from a position close to the edge of the hole towards the ground plane.

5. A multiband antenna according to claim 1, said third frequency being located in a range of the antenna's second operating band to widen this band.

6. A multiband antenna according to claim 1, the radiating element together with the ground plane further being arranged to resonate at a fourth frequency.

7. A multiband antenna according to claim 6, comprising a second tuning element changing the capacitance between the radiating element and the ground plane to set said fourth frequency.

8. A multiband antenna according to claim 7, the second tuning element being a conductor strip connected to the ground plane by a ground conductor.

9. A multiband antenna according to claim 6, said fourth frequency being located in a range of the antenna's second operating band to widen this band.

10. A multiband antenna according to claim 1, the radiating element being a part of a cover of the radio device.

11. A multiband antenna according to claim 1, the feed element being a conductor strip on a surface of a dielectric layer, which is located against the radiating element.

12. A radio device provided with a multiband antenna having at least a first and a second operating band comprising a ground plane, a radiating element, a feed element, a feed conductor and a shorting conductor, wherein the radiating element is galvanically insulated from the other conductive parts of the radio device, and the feed conductor and the shorting conductor are connected to the feed element, a connection point of the shorting conductor divides the feed element into a first part and a second part, the first part of the feed element together with the radiating element and the ground plane are arranged to resonate in a range of the antenna's first operating band, and the second part of the feed element together with the radiating element and the ground plane are arranged to resonate in a range of the antenna's second operating band, and the radiating element has a hole, which is arranged to resonate at a range of an operating band.

13. A radio device according to claim 12 comprising a first display and a second display, the radiating element being a part of a cover of the radio device, and said hole at the same time being a hole made in said part of the cover for the second display.

14. A radio device according to claim 13, being of the foldable type which has a first and second fold parts, and said part of the cover being a rear cover of the second fold part.

* * * * *